US007400099B2

(12) United States Patent
Kasanuki et al.

(10) Patent No.: US 7,400,099 B2
(45) Date of Patent: Jul. 15, 2008

(54) FLAT PANEL IMAGE DISPLAY DEVICE

(75) Inventors: Yuji Kasanuki, Isehara (JP); Shoshiro Saruta, Sagamihara (JP); Daisuke Sasaguri, Yokohama (JP); Ryoji Fujiwara, Chigasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/747,338

(22) Filed: May 11, 2007

(65) Prior Publication Data

US 2007/0267657 A1 Nov. 22, 2007

(30) Foreign Application Priority Data

May 19, 2006 (JP) ..... 2006-140877

(51) Int. Cl.
*G09G 3/10* (2006.01)

(52) U.S. Cl. ..... 315/169.3; 313/495

(58) Field of Classification Search ..... 315/169.1, 315/169.2, 169.3, 169.4; 313/495, 494, 496
See application file for complete search history.

(56) References Cited

U.S. PATENT DOCUMENTS

| | | | | |
|---|---|---|---|---|
| 5,912,531 | A | 6/1999 | Hasegawa et al. | 313/495 |
| 5,936,342 | A | 8/1999 | Ono et al. | 313/495 |
| 6,278,234 | B1 | 8/2001 | Ono et al. | 313/495 |
| 6,313,571 | B1 | 11/2001 | Hasegawa et al. | 313/309 |
| 6,384,541 | B1 * | 5/2002 | Ohnishi et al. | 315/169.3 |
| 6,409,566 | B1 | 6/2002 | Hasegawa et al. | 445/24 |
| 2002/0047574 | A1 * | 4/2002 | Kojima et al. | 315/169.3 |

FOREIGN PATENT DOCUMENTS

| | | |
|---|---|---|
| JP | 3-261024 | 11/1991 |
| JP | 9-082245 | 3/1997 |
| JP | 11-250839 | 9/1999 |

* cited by examiner

*Primary Examiner*—David H Vu
(74) *Attorney, Agent, or Firm*—Fitzpatrick, Cella, Harper & Scinto

(57) ABSTRACT

A flat panel image display device includes a rear plate including plural electron emission elements, a face plate disposed opposed to the rear plate, fluorescent members being disposed on a surface of the face plate opposed to the rear plate, and the fluorescent members being covered with a metal back film, and a voltage applying unit to apply an acceleration voltage of 8 kV to 15 kV between the rear plate and the face plate. In addition, the metal back film has a getter material, and a current luminance characteristic of the fluorescent member satisfies $\gamma \geqq 0.9$ if $L=kI^{\gamma}$, wherein L is luminance, I is an irradiation current, and k is a constant.

5 Claims, 6 Drawing Sheets

R: RED FLUORESCENT MEMBER
G: GREEN FLUORESCENT MEMBER
B: BLUE FLUORESCENT MEMBER

FLAT PANEL IMAGE DISPLAY DEVICE

BACKGROUND OF THE INVENTION

1. Field of the Invention

The present invention relates to a flat panel image display device which uses an electron source.

2. Description of the Related Art

In recent years, a so-called flat panel display attracts attention as an image display device instead of a large and heavy cathode-ray tube. In particular, a liquid crystal display is actively researched and developed. However, it remains as a problem that a view angle is narrow and there is persistence of vision.

On the other hand, a self-emitting flat panel display which displays an image through fluorescence by irradiating an electron beam emitted from an electron source to a fluorescent member is actively researched and developed. As compared with the liquid crystal display, the self-emitting flat panel display can acquire a light image and a wide view angle, and does not remain persistence of vision. For this reason, the self-emitting flat panel display is expected to take the place of the liquid crystal display, in terms of requests of a large-sized screen and a high-definition image.

In regard to the self-emitting flat panel display, Japanese Patent Application Laid-Open No. H03-261024 discloses a flat panel image display device in which electron emission elements for emitting electron beams are disposed within a vacuum panel located between a face plate and a rear plate. In Japanese Patent Application Laid-Open No. H03-261024, the flat panel image display device, which uses a surface-conduction electron emission element as the electron emission element, accelerates the emitted electron beam, irradiates the accelerated electron beam to a fluorescent member, causes fluorescence of the fluorescent member, and thus displays an image.

FIG. 8 is a schematic cross section diagram illustrating a face plate of such an image display device. As illustrated in FIG. 8, the face plate includes a glass substrate 1007, a fluorescent member 1008, a metal back 1009, and a black conductive member (black matrix) 1010. The internal pressure of the flat panel image display device which accelerates and irradiates the electron beam to the fluorescent member 1008 so as to display an image is maintained to a vacuum of $10^{-6}$ torr or less. Here, to maintain vacuum is important with the objective of a time-dependent change of luminance, occurrence of luminance variation, and the like. In this connection, Japanese Patent Application Laid-Open No. 09-082245 discloses a flat panel image display device in which a metal back has a getter material.

The reason why the metal back 1009 like this has a getter material is as follows. That is, in the image display device which uses the electron source, since it is impossible to avoid generating gas from an image display member such as the fluorescent member 1008 or the like which is impacted by high-energy electron, it is feared that the generated gas affects a characteristic because the generated gas adsorbs to an electron emission unit of the electron source. Therefore, to sufficiently adsorb such gas, the metal back 1009 provided within an image display range is constituted to have the getter material.

On the occasion when the high-energy electrons bombard and penetrate into the fluorescent member 1008, some of the electrons are scattered backward by the metal back 1009 and the fluorescent member 1008. Then, the backward scattered electrons are accelerated through an electric field, and the accelerated electrons again bombard and penetrate into the metal back 1009 and the fluorescent member 1008 located nearby. Consequently, a phenomenon called halation that fluorescence of the fluorescent member 1008 of a pixel not driven occurs. Further, if the metal back 1009 has the getter material, it is contemplated that a percentage of the electrons scattered backward increases. This is because the material to be used as the getter material includes the element heavier than aluminum to be ordinarily used as the metal back, and thus a backscattering coefficient increases.

As a countermeasure for the halation, Japanese Patent Application Laid-Open No. H11-250839 discloses an image display device in which a third electrode is provided between a rear plate and a face plate. However, it is feared that this kind of third electrode complicates the constitution of the flat panel display and thus increases manufacturing costs.

In the flat panel image display device, as described above, some of the electron beams irradiated to the metal back 1009 are scattered backward. If the metal back 1009 has the getter material, since a mean atomic number of the elements included in the metal back is larger than that of aluminum used as the metal back 1009, the electrons scattered backward increase. Then, the electrons scattered backward are accelerated through the electric field, and the accelerated electrons again bombard and penetrate into the fluorescent member 1008. Here, if an amount of the electrons bombarded and penetrated again is large, the halation occurs, thereby preventing a contrast on the flat panel display.

SUMMARY OF THE INVENTION

An object of the present invention is to provide a flat panel image display device which can acquire a high contrast.

Another object of the present invention is to provide a flat panel image display device which can acquire a high contrast even if electrons scattered backward again bombard and penetrate into a fluorescent member.

The present invention is directed to a flat panel image display device which comprises: a rear plate including plural electron emission elements; a face plate disposed opposed to the rear plate, fluorescent members being disposed on a surface of the face plate opposed to the rear plate, and the fluorescent members being covered with a metal back film; and a voltage applying unit adapted to apply an acceleration voltage of 8 kV to 15 kV between the rear plate and the face plate, wherein the metal back film has a getter material, and a current luminance characteristic of the fluorescent member satisfies $\gamma \geqq 0.9$ if $L=kI^{\gamma}$ (L is luminance, I is an irradiation current, and k is a constant).

Further features of the present invention will become apparent from the following description of the exemplary embodiments with reference to the attached drawings.

DESCRIPTION OF THE EXEMPLARY EMBODIMENTS

A flat panel image display device according to the present invention is characterized by comprising: a rear plate including plural electron emission elements; a face plate disposed opposed to the rear plate, fluorescent members being disposed on a surface of the face plate opposed to the rear plate, and the fluorescent members being covered with a metal back film; and a voltage applying unit adapted to apply an acceleration voltage of 8 kV to 15 kV between the rear plate and the face plate, wherein the metal back film has a getter material, and a current luminance characteristic of the fluorescent member satisfies $\gamma \geqq 0.9$ if $L=kI^{\gamma}$ (L is luminance, I is an irradiation current, and k is a constant).

In the flat panel image display device of the present invention, a value equal to or larger than 0.9, that is, close to 1.0 can be achieved as a γ characteristic value in a current luminance characteristic while maintaining an effect of having the getter material on the metal-back, and a luminance ratio due to the electrons again bombarded and penetrated by the backscattering for the luminance caused by the primary electron is effectively reduced. As a result, a degree of light emission intensity at a primary electron irradiation portion becomes larger, and a high contrast image can be acquired.

Hereinafter, the exemplary embodiments of the present invention will be described.

Figure 1:
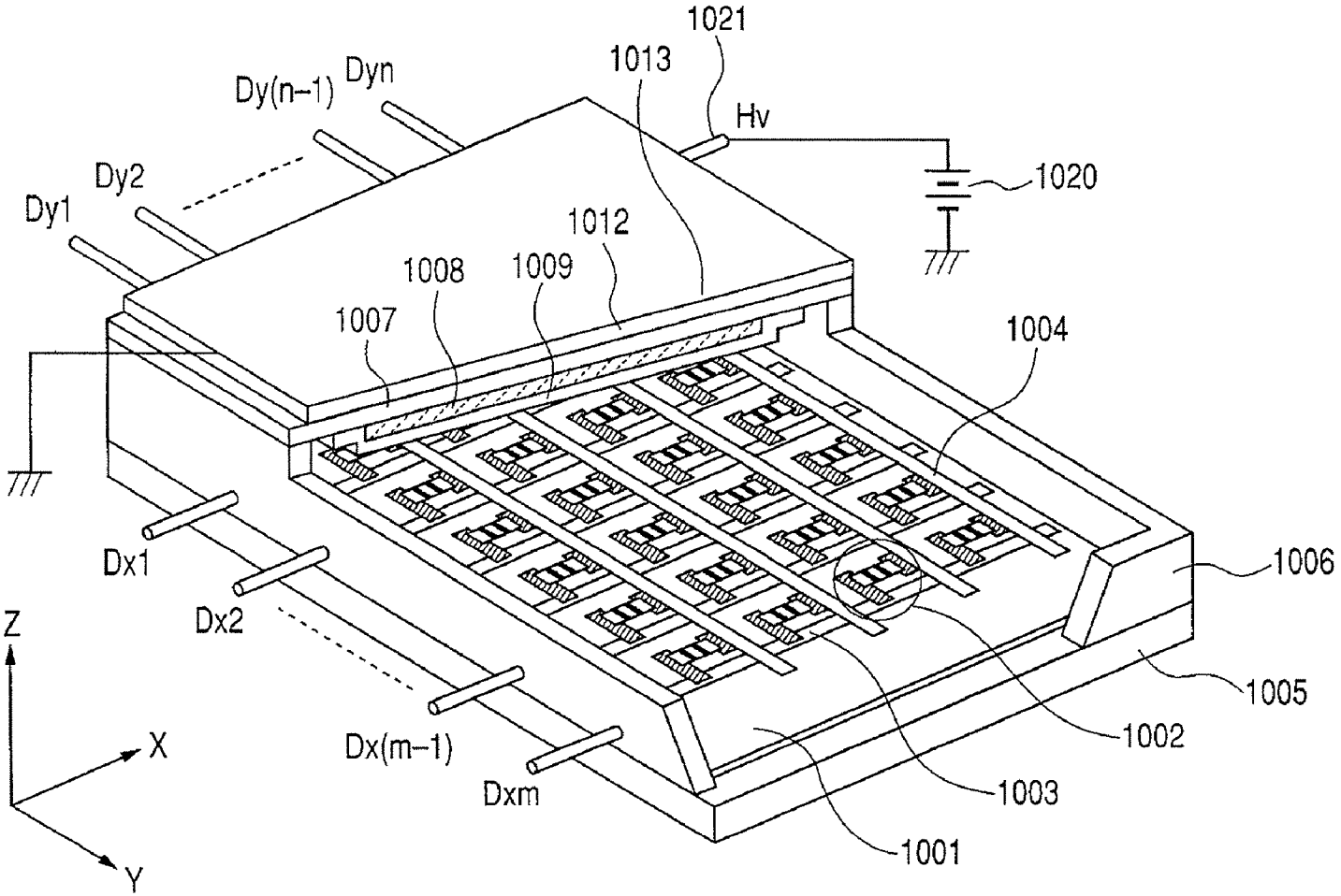
FIG. 1 is an external perspective view of a flat panel image display device, which is partially cut away, according to the exemplary embodiments of the present invention.

FIG. 1 is a perspective view of the flat panel image display device used in the present exemplary embodiments, and this image display device is illustrated by cutting away a part of a display panel in order to show the internal constitution. As illustrated in FIG. 1, an airtight container to maintain an inside of the display panel in a vacuum state is formed by members of a rear plate 1005, a side wall 1006 and a face plate 1007. In a process of assembling this airtight container, joining portions of the respective members must be sealed in order to keep the sufficient intensity and the airtightness. This seal bonding can be carried out by applying, for example, the frit glass to the joining portions and performing the baking at 400° C. to 500° C. for over ten minutes in the air or the nitrogen atmosphere.

Electrons sources of the flat panel image display device are not restricted if they are used in the flat panel image display device, that is, such as surface-conduction electron emission elements, Spindt-type field emission elements, or MIM-type electron emission elements. It is preferable to use the surface-conduction electron emission elements which are easily manufactured, realize the high luminance and suitable for enlarging a display screen. The present exemplary embodiment will be described by using the surface-conduction electron emission elements as an example.

A substrate 1001 is fixed on the rear plate 1005. Surface-conduction electron emission elements 1002 having N×M elements are formed on the substrate 1001 (here, N and M are positive integers equal to or larger than two, which are properly selected in accordance with the objective numbers of display pixels). These N×M surface-conduction electron emission elements are simply matrix wired by M row-direction wirings 1003 and N column-direction wirings 1004. The portion including the above-described members 1001 to 1004 is called a multi-electron source.

In the present exemplary embodiment, the substrate 1001 of the multi-electron source was fixed on the rear plate 1005 of the airtight container. However, the substrate 1001 itself of the multi-electron source may be used as the rear plate 1005.

Figure 2A:
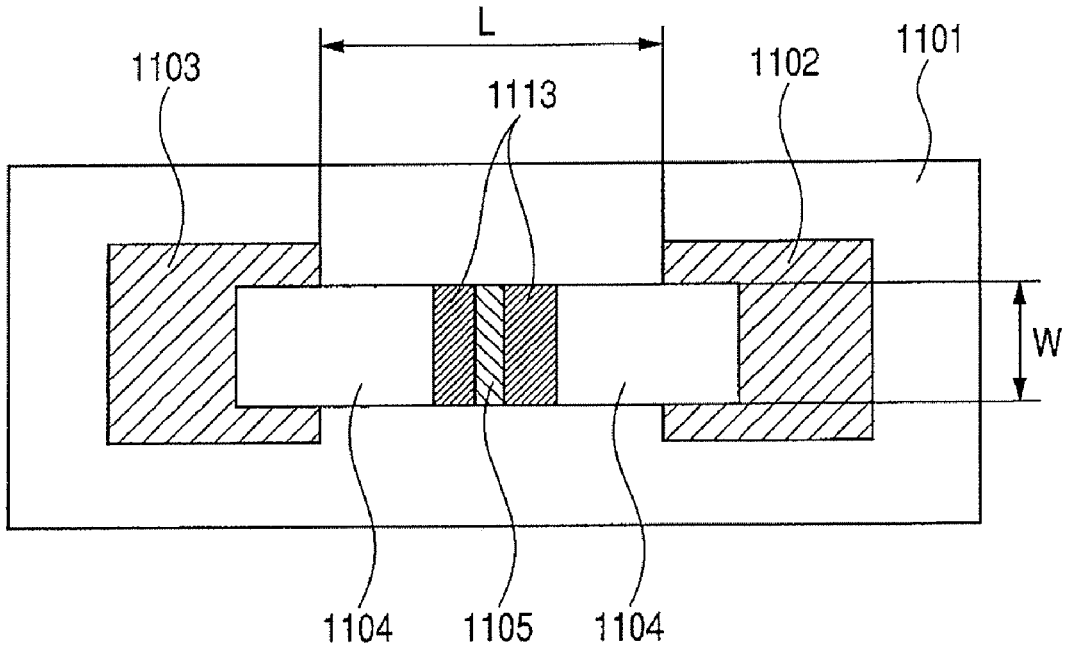
FIG. 2A is a plan view illustrating the constitution of a surface-conduction electron emission element according to the exemplary embodiments of the present invention.
Figure 2B:
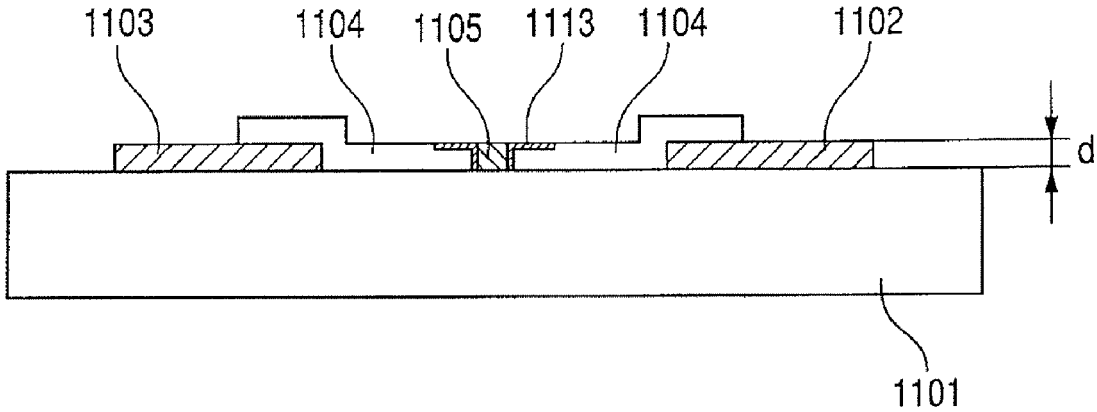
FIG. 2B is a cross section diagram illustrating the constitution of the surface-conduction electron emission element according to the exemplary embodiments of the present invention.

The element constitution of the surface-conduction electron emission element will be described. FIGS. 2A and 2B are respectively a plan view and a cross section diagram used for describing the constitution of the surface-conduction electron emission element. A substrate 1101, element electrodes 1102 and 1103, an electroconductive thin film 1104, an electron emission portion 1105 formed by an energization forming process, and a thin film 1113 formed by an energization activation process are illustrated in FIGS. 2A and 2B.

As the substrate 1101, various glass substrates, various ceramic substrates including alumina or substrates formed by laminating insulation layers made from, for example, $SiO_2$ on the above-described various substrates can be used.

The element electrodes 1102 and 1103 oppositely provided on the substrate 1101 in parallel with a surface of the substrate are formed by electroconductive materials. Such the electroconductive materials are properly selected from among metal or alloy represented by, for example, Ni, Pt, Cr, Au, Mo, W, Ti and Cu, metal oxide and semiconductor. The element electrode can be easily formed if the film forming technology such as vacuum vapor deposition is combined with the patterning technology such as photolithography and etching. However, as an electrode forming method, another method such as printing is allowed.

Shapes of the element electrodes 1102 and 1103 are properly designed according to an application purpose of electron emission elements. Generally, a space L between electrodes is designed by selecting a suitable value from a range of several hundreds angstroms (Å) to several hundreds micrometers (μm) usually. However, a preferable space L to be applied to an image display device is within a range of several micrometers (μm) to several tens micrometers (μm). A width W of the electron emission portion is within a range of several tens micrometers (μm) to several hundreds micrometers (μm). As to a thickness d of the element electrode, a suitable value is selected from a range of several hundreds angstroms (Å) to several micrometers (μm) usually.

A fine-grain film is used for a portion of the electroconductive thin film 1104. The fine-grain film mentioned here indicates a film which contains a large number of fine-grains as the composing member (including island-shaped aggregation).

Although the grain sizes of the fine-grains used in the fine-grain film are within a range of several angstroms (Å) to several thousands angstroms (Å), a range of 11 Å to 200 Å is more preferable. As materials which can be used in forming the fine-grain film, they are properly selected from among metal represented by, for example, Pd, Pt, Ru, Ag, Au, Ti, In and Cu, oxide, boride, nitride and sulfide.

The electron emission portion 1105, which is a fissure formed on a part of the electroconductive thin film 1104, has a characteristic of high resistance electrically higher than that of the peripheral electroconductive thin film. The fissure is formed by executing the energization forming process to the electroconductive thin film 1104. In the fissure, there is a location of disposing a fine-grain of which the size is within a range of several angstroms (Å) to several hundreds angstroms (Å).

The thin film 1113, which is formed by carbon or a carbon compound, coats the electron emission portion 1105 and its periphery. The thin film 1113 is formed by executing the energization activation process after the execution of the energization forming process.

Meanwhile, a transparent (light transmitting) electroconductive film is formed on a surface of the face plate 1007. A protection plate 1013 having an antistatic film 1012 is further fixed on the transparent electroconductive film by an adhesive layer (both the transparent electroconductive film and the adhesive layer are not illustrated). These members are used to remove the charge generated when a high voltage is applied, and if such the discharging function is given, it is not always limited to the above-described constitution. A fluorescent member 1008 and a metal back 1009 are provided on a back surface of the face plate 1007. A high voltage is applied to the metal back 1009 of the face plate 1007 by a high-voltage power supply 1020 through a high-voltage input terminal 1021.

Figure 3A:
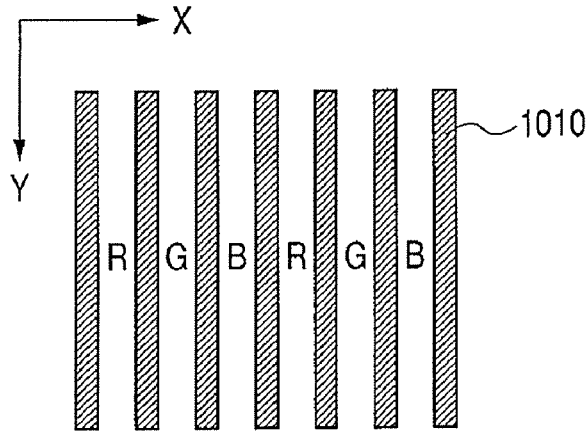
FIGS. 3A, 3B and 3C are plan views exemplifying the arrangement of fluorescent members on a face plate.

The fluorescent member 1008 is provided on the back surface of the face plate 1007. Fluorescent members of three primary colors of red, green and blue are separately applied to a portion of the fluorescent member 1008. The fluorescent members of the respective colors are separately applied, for example, in a stripe state as indicated in FIG. 3A. As an object of providing a black electroconductive member (black matrix) 1010 between the stripes of the fluorescent member, the following points can be enumerated.

(1) It intends to prevent to generate color drift in the display color even if an irradiating position of the electron beam is slightly shifted.

(2) It intends to prevent deterioration of the display contrast by preventing reflection of the outside light.

(3) It intends to prevent the charge-up of a fluorescent film due to the electron beam.

Although graphite is used for the black matrix 1010 as a main component, another material may be used if it attains the above-described object.

Figure 3B:
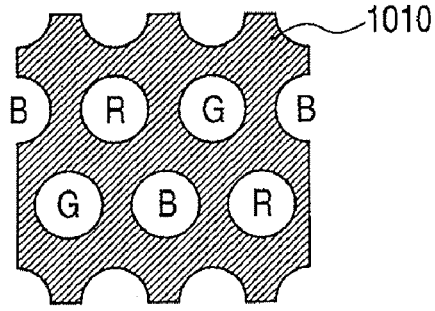
Figure 3C:
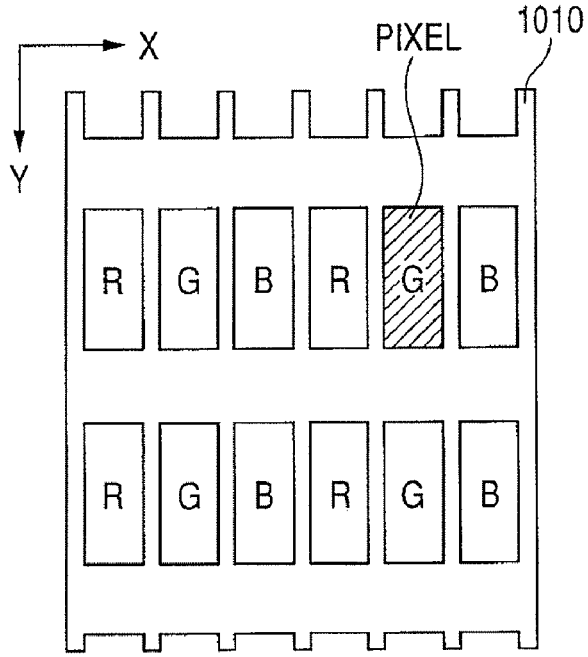

An applying method of the fluorescent member of three primary colors is not limited to the arrangement in a stripe state as indicated in FIG. 3A, but may be, for example, the arrangement in a delta state as indicated in FIG. 3B, the arrangement in an oblong state as indicated in FIG. 3C or another arrangement.

The metal back 1009 includes the getter material. For example, the metal back may be coated with a layer including the getter material. In this case, it is allowed that the getter material is disposed on the black matrix 1010 through the metal back 1009, a thickness of the metal back 1009 is equal to or less than 50 nm and the getter material is a film having a thickness of 30 nm to 50 nm.

Furthermore, it is allowed that the metal back 1009 includes the getter material or is made form the getter material. In this case, the getter material may be a film having the function as the metal back which has a thickness of 50 nm to 70 nm.

In a case that the getter material is made from an alloy which includes Ti and Zr or at least one of them as the main component, a more preferable degree of vacuum can be acquired, and it is preferable in a point that the luminance deterioration and luminance variation (or dispersion) can be suppressed and reduced. In addition, the alloy may include one or more elements of Al, V and Fe as the accessory component.

In a case that an image is displayed by such the flat panel image display device, an acceleration voltage is applied to a space between a face plate and a rear plate within a range of 8 kV to 15 kV. In a case that the acceleration voltage is equal to or less than 8 kV, since the luminance can not be sufficiently secured, the acceleration voltage more than 8 kV is required. An upper limit of the acceleration voltage is set by the following reason. Judging from the shape of the flat panel image display device, a distance between a cathode (rear plate) and an anode (face plate) is considerably shorter than that of a CRT (Cathode Ray Tube). Even if it is estimated longer, a distance between the cathode and the anode is about several millimeters. If a distance between the cathode and the anode is short, since an electrical discharge tends to generate, in the flat panel image display device, the acceleration voltage of an electron beam is more restricted than that in the CRT. Judging from a tendency to generate the electrical discharge, in a space of merely several millimeters between the cathode and the anode, it is preferred that the acceleration voltage is equal to or less than 15 kV.

Figure 4:
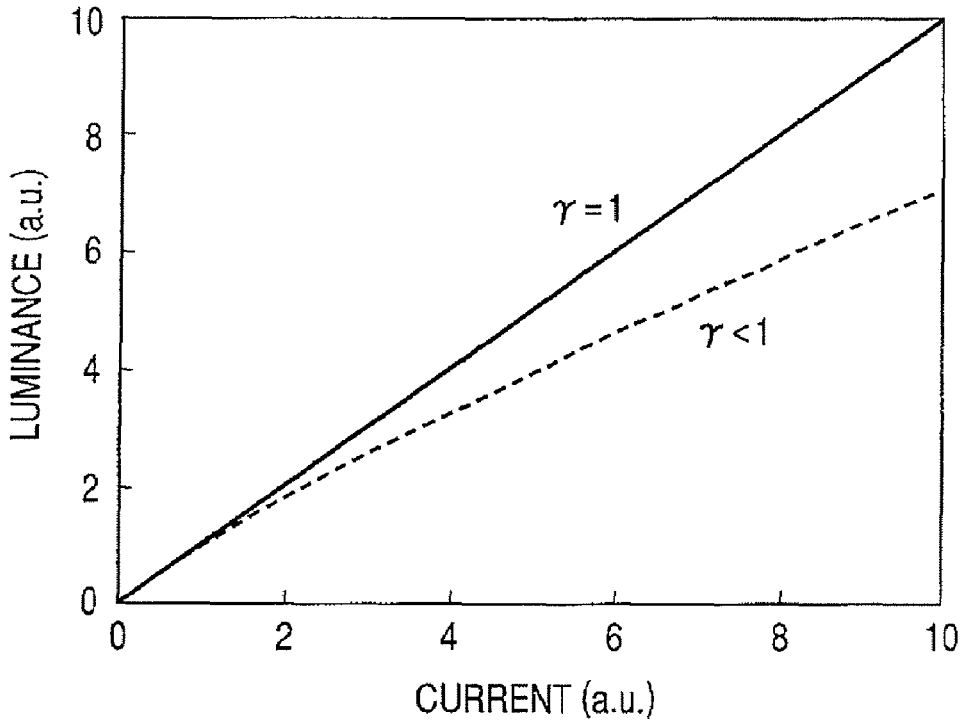
FIG. 4 is a graph for describing a γ characteristic of the fluorescent member.
Figure 5:
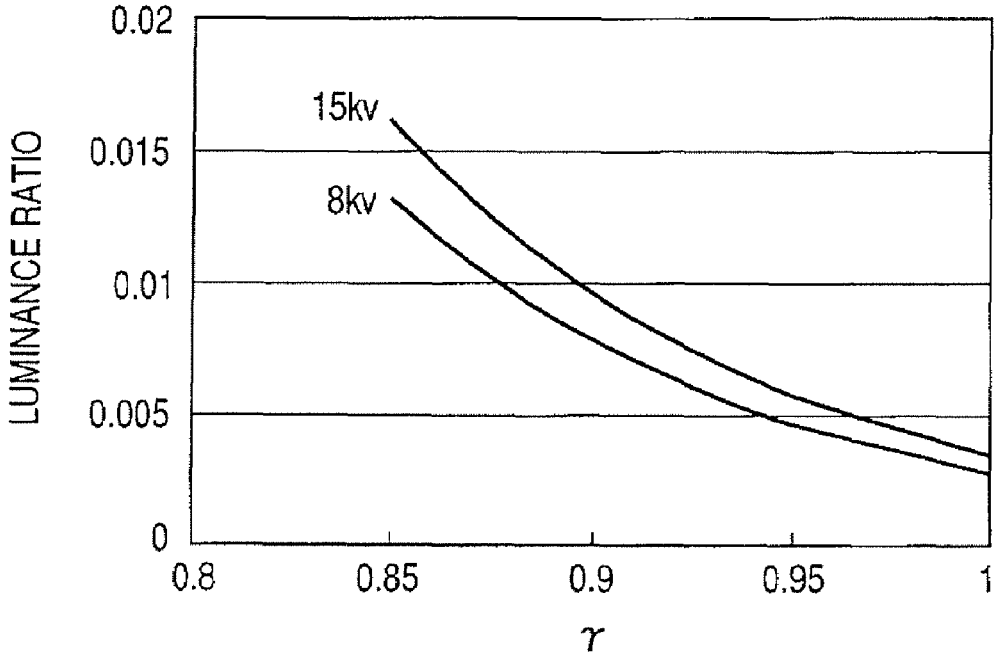
FIG. 5 is a graph indicating a relationship between the γ characteristic of the fluorescent members and the ratios between the luminance of halation light emission and the luminance of a luminescent spot.

In the flat panel image display device constituted as above, the present inventor has investigated about the fluorescent member 1008 in order to suppress light emission at an unnecessary part even if electrons irradiated to the metal back 1009 and the fluorescent member 1008 again bombard and penetrate into the fluorescent member 1008. FIG. 4 indicates a luminance characteristic, that is, the $\gamma$ characteristic, when the electrons are irradiated to the fluorescent member 1008. Generally, a luminance L of the fluorescent member has the relationship of $L=kI^{\gamma}$ (k is a constant) between the luminance L and a current I which is to be applied to the fluorescent member. Although the $\gamma$ value is mainly determined by the material of the fluorescent member, this value changes also with a manufacturing method even if the same material is used. The present inventor has investigated about a relationship between various $\gamma$ values and the ratios between the light emission luminance at unnecessary parts due to halation and the luminance of original luminescent spots. The metal back 1009 is constituted to include the getter material. Here, the getter material, which was fabricated by laminating Zr with a thickness of 30 nm after forming a metal film of Al with a thickness of 50 nm, was used. FIG. 5 indicates an inspection result. In FIG. 5, a lateral axis denotes $\gamma$ values and a vertical axis denotes ratios of the luminance of the luminescent spots to the light emission luminance at unnecessary parts. When the $\gamma$ value of the fluorescent member is increased, the luminance ratio becomes small. In addition, the more the acceleration voltage becomes small, the more the luminance ratio becomes small. That is, the halation is suppressed.

The present inventor has investigated also about the detection limit according to subjective assessment for the uneven luminance. As a result, the detection limit for the uneven luminance generated at a portion adjacent to the luminescent spot resulted in a level of 1%. Therefore, in order to display an excellent image with high contrast, the light emission due to the halation at a portion adjacent to the luminescent spot is required to be a level equal to or less than 1%.

That is, in the flat panel image display device, it is preferable that the $\gamma$ value is equal to or larger than 0.9 in a range of the acceleration voltage equal to or less than 15 kV. In this case, the uneven luminance at a portion adjacent to the luminescent spot becomes a level equal to or less than 1%, and an excellent display image with high contrast can be acquired.

As the material of the fluorescent member for giving such the $\gamma$ value, a strontium thiogallate to which a europium (Eu) is added as an activator is preferable. This material has a large $\gamma$ value and the high intensity of light emission. The strontium thiogallate to which the europium is added is a compound expressed by a chemical formula $SrGa_2S_4$:Eu. The Eu is solidly soluble in a $SrGa_2S_4$ and can be stably added to the $SrGa_2S_4$. Here, the Eu is added to the Sr with the concentration of 0.5 at % to Sat %. The high luminance can be acquired by selecting a ratio of the concentration of the Eu from among the above-described range.

The uneven luminance due to the halation generates for each of three colors of R, G and B. In particular, as to the G (green) fluorescent member undertaking a major part of the luminance, its influence is great. Therefore, it is especially effective to use the γ value, which is equal to or larger than 0.9 (i.e., $\gamma \geqq 0.9$), for the G (green) fluorescent member.

Figure 6:
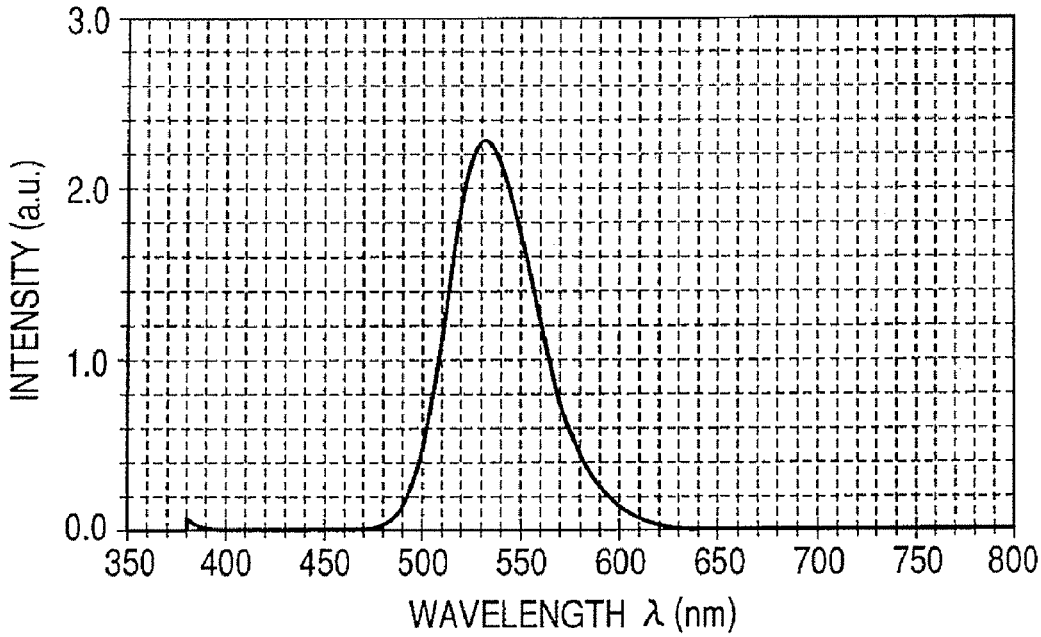
FIG. 6 is a graph indicating an example of spectrum of the cathode luminescence of $SrGa_2S_4$:Eu according to the exemplary embodiments of the present invention.

It is considered that the Eu is ionized to a bivalent ion and is displaced by the Sr. The light emission of $Eu^{2+}$ is caused by an allowed transition between an orbit 5f and an orbit 4d (5f–4d) and indicates a simple one-curved emission spectrum, and its peak wavelength is about 530 nm. A fact that the Eu is ionized to a bivalent ion and is displaced can be confirmed by measuring the emission spectrum. FIG. 6 indicates an example of spectrum of the cathode luminescence of the $SrGa_2S_4$:Eu. A spectrum having the peak wavelength of 530 nm according to the allowed transition between the orbit 5f and the orbit 4d (5f–4d) is acquired, and a light emitting component does not exist excepting such the emission spectrum.

There are various methods of fabricating the $SrGa_2S_4$:Eu. Initially, SrS and $Ga_2S_3$ are weighed to become stoichiometry and then they are mixed. The additive Eu is added as $EuCl_2$ with a ratio of Eu to Sr to become a range of 0.5 at % to 5 at %. A small amount of ethanol is mixed with the above-described acquired substance, and such the processed substance was molded by the press and dried. Thereafter, it was thermally processed for an hour at 800° C. to 900° C. in the Ar—$H_2S$ mixed atmosphere to form the $SrGa_2S_4$:Eu.

After crushing and milling this $SrGa_2S_4$:Eu, the acquired fine-grains are mixed with resin and solvent to form the paste. The $SrGa_2S_4$:Eu formed into the paste is applied on the face plate by a screen printing method and then such the face plate was baked at 450° C. for ten minutes. In this manner, fluorescent member patterns can be acquired on the face plate.

Alternatively, the $SrGa_2S_4$:Eu can be formed from the materials such as $SrCO_3$, $GaO_3$ and $EuO_3$ which are regarded as primary materials. These three materials are weighed to become stoichiometry composition and then they are well mixed. At this time, a bit of NaBr may be added as sintering aids. As the sintering aids, Kbr or $LiCO_3$ can be used in addition to NaBr. A small amount of ethanol is mixed with the above mixed materials, and such the processed substance is molded by using a press machine, and then it was baked at 800° C. for two hours in the Ar—$H_2S$ mixed atmosphere ($H_2S$: 50%, Ar: 50%).

A pasting process was executed by the same method as that of the foregoing.

Alternatively, there is a method of forming sulfide via oxide. Initially, the oxide is formed, and then oxygen is displaced by sulfur to form the sulfide. As the primary materials, $SrCl_3$, $GaO_3$ and $EuCl_3$ are weighed to become stoichiometry composition and then they are well mixed. Such the processed substance is thermally processed at 900° C. in the air to form a $SrGa_2O_4$:Eu. The formed $SrGa_2O_4$:Eu is further thermally processed at 900° C. to 1000° C. in the Ar—$H_2S$ mixed atmosphere ($H_2S$: 50%, Ar: 50% volume ratio) to form the $SrGa_2S_4$:Eu.

Figure 7:
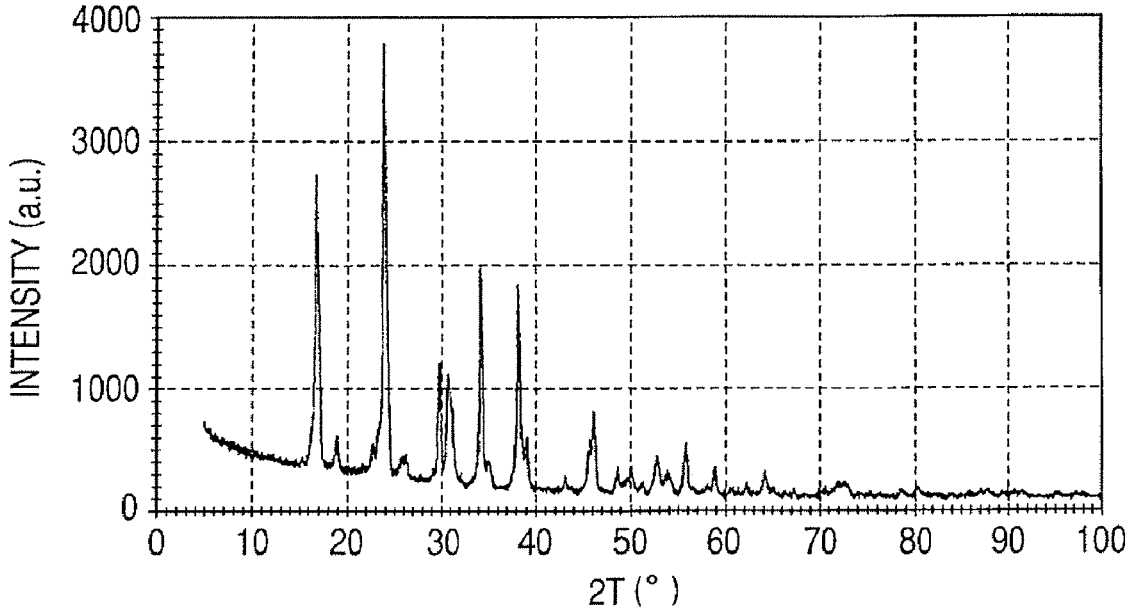
FIG. 7 is a chart indicating an example of pattern of the X-ray diffraction of the $SrGa_2S_4$:Eu according to the exemplary embodiments of the present invention.
Figure 8:
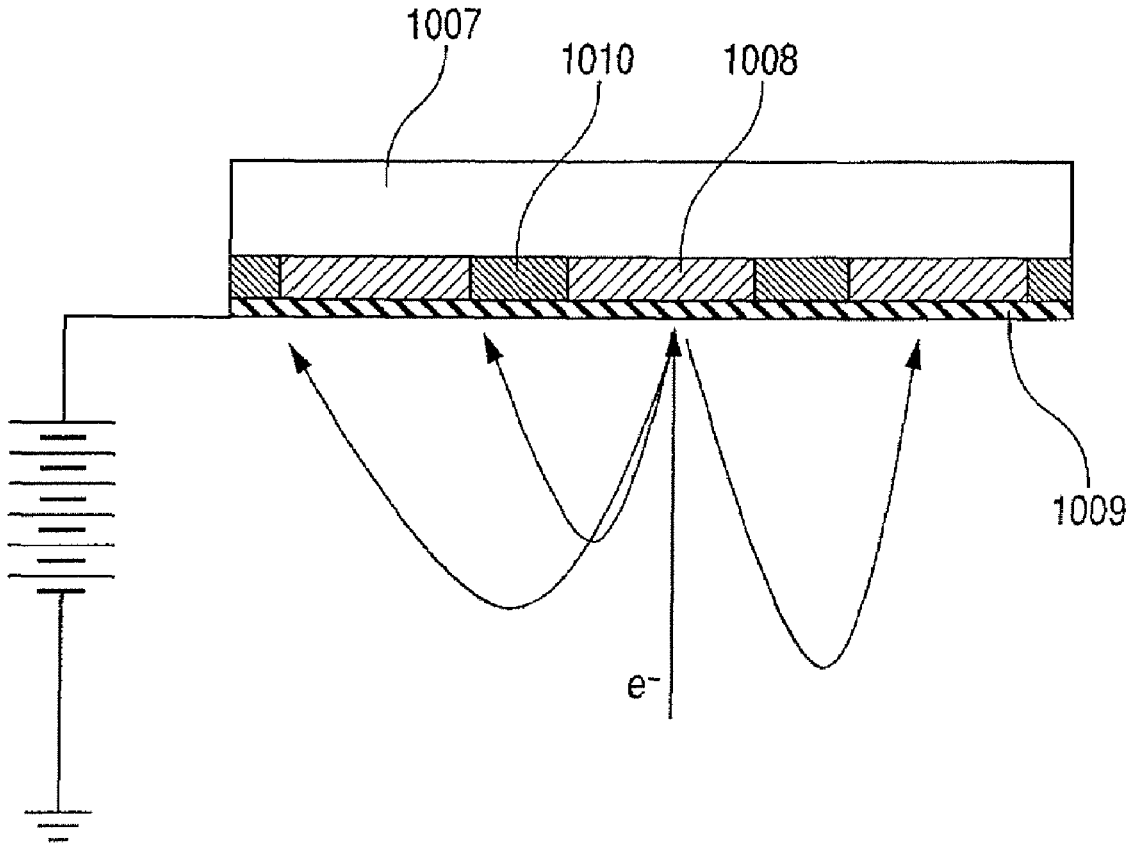
FIG. 8 is a cross section diagram illustrating the face plate.

When the $SrGa_2S_4$:Eu formed in this manner is analyzed by an X-ray diffraction, it was confirmed that the composition formed from Sr, Ga and S is a crystal of the $SrGa_2S_4$. The acquired pattern of the X-ray diffraction is indicated in FIG. 7. The peak other than that of the crystal of the $SrGa_2S_4$ can not be observed, therefore it is understood that the $SrGa_2S_4$ is formed.

Furthermore, there is also a synthesis method of forming the $SrGa_2S_4$:Eu by using nitrate such as $Sr(NO_3)_3$ or $Ga(NO_3)_3$, chloride and sulfide.

As a synthesis method of forming the $SrGa_2S_4$:Eu, the above-described method is preferably used, and if it is a method where the peak other than that of the $SrGa_2S_4$:Eu can not be observed and the compound having a spectrum, which is a spectrum of the cathode luminescence, caused by the transition of the Eu between the orbit 4f and the orbit 5d (4f–5d) can be acquired, such the method is allowable. And, fluctuation of the composition is allowable within this scope.

The γ value of the $SrGa_2S_4$:Eu acquired by using the above-described synthesis method can be set to a range of 0.95 to 1.0, and a value equal to or larger than 0.9 can be easily acquired.

According to the present invention, in the flat panel image display device, the light emission at an unnecessary part due to the backscattering electrons generated in case of incidence of the electron beam on the image display member such as the metal back or the fluorescent member can be suppressed, and a high contrast image can be displayed. Particularly, the $SrGa_2S_4$:Eu, which has the high intensity of light emission and can stably acquire the high γ value, is suitable for the fluorescent member of the flat panel image display device.

In the flat panel image display device of the present invention, the light emission at an unnecessary part due to the backscattering electrons can be suppressed also in the constitution that the getter material is contained in the metal back by using the fluorescent member having the γ value equal to or larger than 0.9, and a high contrast image can be display. More preferably, by using the $SrGa_2S_4$:Eu as the fluorescent member, the high intensity of light emission can be realized, the high γ value can be stably acquired, and an image having the high luminance and the high contrast can be displayed.

EXAMPLES

Hereinafter, the flat panel image display device of the present invention will be described in further detail by the following examples.

Example 1

The flat panel image display device having the constitution illustrated in FIG. 1 was assembled by using a rear plate which has an insulating substrate of the high strain point glass and a face plate which has a substrate composed of the high strain point glass. The surface-conduction electron emission elements are formed on the insulating substrate of the high strain point glass at the side of the rear plate. The fluorescent member and a metal back film are provided on an inner surface of the substrate of the face plate composed of the high strain point glass. The metal back film was fabricated in a manner that an Al thin film having a thickness of 50 nm was formed and then a getter layer composed of a Ti—Al alloy was laminated on the metal back. A thickness of the Ti—Al alloy was set to 50 nm. These members were formed by a sputtering method, and an elemental ratio of the target composition is resulted in that the ratios of Ti and Al are respectively equal to 85% and 15% (element ratio). A predetermined degree of vacuum is maintained in a space inside the device, and the acceleration voltage of 15 kV is used.

The fluorescent member at the side of the face plate was formed by applying each of materials indicated in Table 1 to the face plate and then baking the face plate. Note that the material of which the element ratio of Eu is about 0.3% was used.

Table 1 indicates the respective γ values and the ratios between the luminance of the luminescent spots and the luminance at unnecessary parts adjacent to the luminescent spots. The light emission at an unnecessary part can be measured by masking a lighting range on a boundary between a non-lighting range and the lighting range. Each of the γ values was acquired by measuring the luminance of the luminescent spot and the luminance at an unnecessary part adjacent to the luminescent spot by using a luminance meter while changing the current magnitude to be applied to the fluorescent member. The luminance ratios and the γ values corresponding to those ratios were acquired for the respective fluorescent members, and Table 1 was acquired. As the γ value becomes larger, the luminance ratio becomes smaller. If the γ value is equal to or larger than 0.9, the luminance ratio becomes to be equal to or less than 1%, and an image excellent in the contrast could be acquired.

TABLE 1

| Material | γ value | Luminance ratio (%) |
|---|---|---|
| ZnS:Cu,Al | 0.76 | >2.0 |
| ZnS:Ag,Al | 0.78 | >2.0 |
| CaS:Ce | 0.82 | 2.0 |
| $Ga_2O_2S$:Tb | 0.84 | 1.7 |
| $Y_2O_2S$:Eu | 0.85 | 1.6 |
| $Y_3Al_5O_{12}$:Tb | 0.91 | 0.9 |
| $Y_2O_3$:Eu | 0.92 | 0.8 |
| $BaAl_2S_4$:Eu | 0.92 | 0.8 |
| $Y_2SiO_5$:Ce | 0.97 | 0.4 |
| $SrGa_2S_4$:Eu | 0.98 | 0.3 |

Example 2

The flat panel image display device was formed by the same method as that in Example 1. In order to form the metal back film, the metal back itself was formed by the getter material. The metal back was formed to have a thickness of 50 nm by the sputtering method, and an alloy made from Zr (75%), V (20%) and Fe (5%) (element ratio) was used for the target composition. Similar to Example 1, a predetermined degree of vacuum is maintained in a space inside the device, and the acceleration voltage of 15 kV is used.

The fluorescent member was formed by applying each of materials indicated in Table 2 to the face plate and then baking the face plate. Here, different samples with the same materials are measured. In order to form the $SrGa_2S_4$:Eu, the substance of which the primary materials are SrS, $Ga_2S_3$ and $EuCl_2$, the substance of which the primary materials are $SrCO_3$, $GaO_3$ and $Eu_2O_3$ and the forming condition changed substance of which the primary materials are $Sr(NO_3)_3$, $Ga(NO_3)_3$ and $EuCl_2$ are used. The $SrGa_2S_4$:Eu stably indicates the high γ value and has the high intensity of light emission in any forming methods, and a display image excellent in the contrast could be acquired. Note that the material of which the element ratio of Eu is about 0.3% was used. Even if the other materials have the high γ values, the intensity of light emission was extremely weak or the stability of the γ value could not be acquired.

TABLE 2

| Material | γ value | Luminance ratio (%) |
|---|---|---|
| $SrGa_2S_4$:Eu(1) | 0.99 | 0.3 |
| $SrGa_2S_4$:Eu(2) | 0.97 | 0.4 |
| $SrGa_2S_4$:Eu(3) | 0.98 | 0.3 |
| $Y_2SiO_5$:Ce(1) | 0.97 | 0.4 |
| $Y_2SiO_5$:Ce(2) | 0.96 | 0.5 |
| $SrP_2O_4$:Eu | 0.98 | 0.3 |
| $SrP_2O_4$:Eu | 0.99 | 0.3 |
| $BaAl_2S_4$:Eu(1) | 0.91 | 0.9 |
| $BaAl_2S_4$:Eu(2) | 0.86 | 1.6 |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent constitutions and functions.

This application claims the benefit of Japanese Patent Application No. 2006-140877, filed May 19, 2006, which is hereby incorporated by reference herein in its entirety.

What is claimed is:

1. A flat panel image display device comprising:

a rear plate including plural electron emission elements;

a face plate disposed opposed to the rear plate, fluorescent members being disposed on a surface of the face plate opposed to the rear plate, and the fluorescent members being covered with a metal back film; and a voltage applying unit adapted to apply an acceleration voltage of 8 kV to 15 kV between the rear plate and the face plate, wherein the metal back film has a getter material, and a current luminance characteristic of the fluorescent member satisfies $\gamma \geqq 0.9$ if $L=kI\gamma$, wherein L is luminance, I is an irradiation current, and k is a constant.

2. A flat panel image display device according to claim 1, wherein one of the fluorescent members is a material represented by $SrGa_2S_4$:Eu.

3. A flat panel image display device according to claim 2, wherein an amount of Eu of the fluorescent member is within a range of 0.5 at % to 5 at % for Sr.

4. A flat panel image display device according to claim 1, wherein the getter material includes at least one kind of Ti and Zr.

5. A flat panel image display device according to claim 1, wherein the electron emission elements are surface-conduction electron emitters.

* * * * *

UNITED STATES PATENT AND TRADEMARK OFFICE

CERTIFICATE OF CORRECTION

PATENT NO. : 7,400,099 B2
APPLICATION NO. : 11/747338
DATED : July 15, 2008
INVENTOR(S) : Yuji Kasanuki et al.

It is certified that error appears in the above-identified patent and that said Letters Patent is hereby corrected as shown below:

COLUMN 5:

Line 56, “form” should read --from--.

COLUMN 7:

Line 49, “the” should be deleted.
Line 59, “the” should be deleted.

COLUMN 8:

Line 34, “display.” should read --displayed.--.

Signed and Sealed this

Twelfth Day of May, 2009

John Doll

JOHN DOLL
*Acting Director of the United States Patent and Trademark Office*